US006074721A

United States Patent [19]

Moore et al.

[11] Patent Number: 6,074,721

[45] Date of Patent: Jun. 13, 2000

[54] TEMPORARY TATTOO DECALS

[76] Inventors: George Moore, 324 Nova Way, Chula Vista, Calif. 92911; Joyce Bordelon, 403 10th St., Del Mar, Calif. 92014

[21] Appl. No.: 08/991,950

[22] Filed: Dec. 16, 1997

Related U.S. Application Data

[60] Provisional application No. 60/033,130, Dec. 18, 1996.

[51] Int. Cl.[7] ..... B41M 3/12

[52] U.S. Cl. ..... 428/42.1; 156/89.11; 283/81; 606/186; 428/42.2; 428/343; 428/354; 428/355 RA; 428/355 CP; 428/914

[58] Field of Search ..... 283/81; 156/89.11; 606/186; 428/343, 354, 355 RA, 355 CP, 914, 42.1, 42.2

[56] References Cited

U.S. PATENT DOCUMENTS

| | | | |
|---|---|---|---|
| 1,627,407 | 5/1927 | Reese . | |
| 1,803,836 | 5/1931 | Bihr . | |
| 1,811,804 | 6/1931 | Poschel . | |
| 2,578,150 | 12/1951 | Rathke . | |
| 2,941,916 | 6/1960 | Akkeron . | |
| 3,681,186 | 8/1972 | Findlay et al. | 161/166 |
| 3,898,357 | 8/1975 | Miller et al. | 428/42 |
| 4,044,181 | 8/1977 | Edhlund | 428/40 |
| 4,060,643 | 11/1977 | Blanks | 428/195 |
| 4,105,483 | 8/1978 | Lin | 156/154 |
| 4,115,602 | 9/1978 | Bullard | 427/140 |
| 4,175,151 | 11/1979 | Eppich et al. | 428/202 |
| 4,522,864 | 6/1985 | Humason et al. | 428/201 |
| 4,594,276 | 6/1986 | Relyea | 428/40 |
| 5,421,765 | 6/1995 | Lehmannn et al. | 446/296 |
| 5,676,401 | 10/1997 | Witkowski et al. | 283/81 |
| 5,681,631 | 10/1997 | Steelman et al. | 428/42 |
| 5,776,586 | 7/1998 | Lipper | 428/195 |
| 5,817,385 | 10/1998 | Stanislav | 428/40.2 |

*Primary Examiner*—Terrel Morris
*Assistant Examiner*—Arti R. Singh
*Attorney, Agent, or Firm*—Fish & Richardson P.C.

[57] ABSTRACT

A temporary decal comprising a porous paper base coated with a water-soluble slip layer (e.g., dextrin gum) on which offset printing inks are directly imprinted using a high speed lithographic press. The inks are printed in a designated area only, in a desired image. A clear spot coating, preferably of an aqueous material, is then printed over the image area only. A contact adhesive is then spot printed over the image area of each decal, preferably using a silk screen press. A removable cover sheet, such as a silicone-coated sheet, is placed over the contact adhesive of each printed sheet of decals to keep the sheets from sticking together. The spot coating acts as a protective layer that keeps the contact adhesive from migrating to the surface of the decal after the finished temporary tattoo is applied to the skin. Without the spot coating, the surface of the decal would become sticky to the touch and the decal would come off faster because of friction with the surrounding environment.

8 Claims, 1 Drawing Sheet

TEMPORARY TATTOO DECALS

This application claims benefit of Provisional Application Ser. No. 60/033,130 filed Dec. 18, 1996.

TECHNICAL FIELD

This invention relates to decalcomanias ("decals"), and more particularly for a method of making and a structure for skin-safe decals used as temporary tattoos.

BACKGROUND OF THE INVENTION

Decals have been used for many decades for decorative effect on a variety of objects. Relatively recently, decals have been used as temporary tattoos for application to skin. See, for example, U.S. Pat. No. 4,522,864 issued to Humason. Humason teaches a decal having a porous paper backing, a water-soluble slip layer on the surface of the paper backing, a microscopically thin, flexible, extensible, water-resistant film covering the slip layer, a very thin translucent multi-color design offset (lithographically) printed on the water-resistant film, and a uniform layer of transparent or translucent pressure sensitive adhesive covering the design. Similar teachings are set forth in U.S. Pat. Nos. 1,627,407 issued to Resse (1927); 2,578,150 issued to Rathke (1947); 2,941,916 issued to Akkeron (1960); and 4,175,151 issued to Eppich et al. (1979).

While suitable decals can be made by many of the processes described in the above references, the art has some drawbacks. For example, decals manufactured in accordance with the method taught in the Humason patent result in a thin flexible transparent sealer film, such as varnish, covering the ink when the tattoo is in place on the skin. The sealer film is outermost on an applied decal, and generally gives a sheen to the underlying ink that spoils some of the effect of the decal appearing to be a real tattoo. Other products described in the references are not ideally suitable for high speed production on a high speed lithographic press. Accordingly, it would be desirable to have method for making and a structure for an improved skin-safe temporary tattoo decal that can be manufactured on high speed lithographic printing presses and which avoid some of the drawbacks of the prior art.

SUMMARY OF THE INVENTION

The present invention comprises a temporary decal comprising a porous paper base coated with a water-soluble slip layer (e.g., dextrin gum) on which offset printing inks are directly imprinted using a high speed lithographic press. The inks are printed in a designated area only, in a desired image. A clear spot coating, preferably of an aqueous material, is then printed over the image area only. A contact adhesive is then spot printed over the image area of each decal, preferably using a silk screen press. A removable cover sheet, such as a silicone-coated sheet, is placed over the contact adhesive of each printed sheet of decals to keep the sheets from sticking together.

The spot coating acts as a protective layer that keeps the contact adhesive from migrating to the surface of the decal after the finished temporary tattoo is applied to the skin. Without the spot coating, the surface of the decal would become sticky to the touch and the decal would come off faster because of friction with the surrounding environment.

In the preferred embodiment, when using an aqueous coating, the spot coating imprints in-line with the offset (lithographic) press using a coating tower or roll-away coating unit incorporated into the last printing unit of the offset press, with a photo-etched cyrel plate defining the spot print areas. In an alternative embodiment, when using a non-aqueous coating material, such as clear varnish, a standard printing unit on the offset press can be used to define and print the spot coating print areas; no cyrel plate is required. In either case, the spot coating can be applied as a second pass on the offset press rather than in-line.

To apply the decals, the protective sheet is removed and the printed decal sheet is placed on the skin, contact adhesive side down. The back of the tattoo sheet, comprising the porous base paper, is saturated with water until the slip layer dissolves. When the slip layer dissolves, the porous base paper is removed, leaving the ink image on the skin, held in place by the contact adhesive.

The details of the preferred embodiment of the present invention are set forth in the accompanying drawings and the description below. Once the details of the invention are known, numerous additional innovations and changes will become obvious to one skilled in the art.

BRIEF DESCRIPTION OF THE DRAWINGS

Like reference numbers and designations in the various drawings indicate like elements.

DETAILED DESCRIPTION OF THE INVENTION

Throughout this description, the preferred embodiment and examples shown should be considered as exemplars, rather than as limitations on the present invention.

Figure 1:
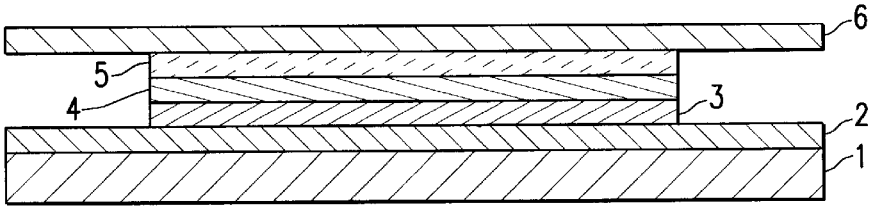
FIG. 1 is a cross-sectional view of a temporary tattoo decal made in accordance with the present invention.
Figure 2:
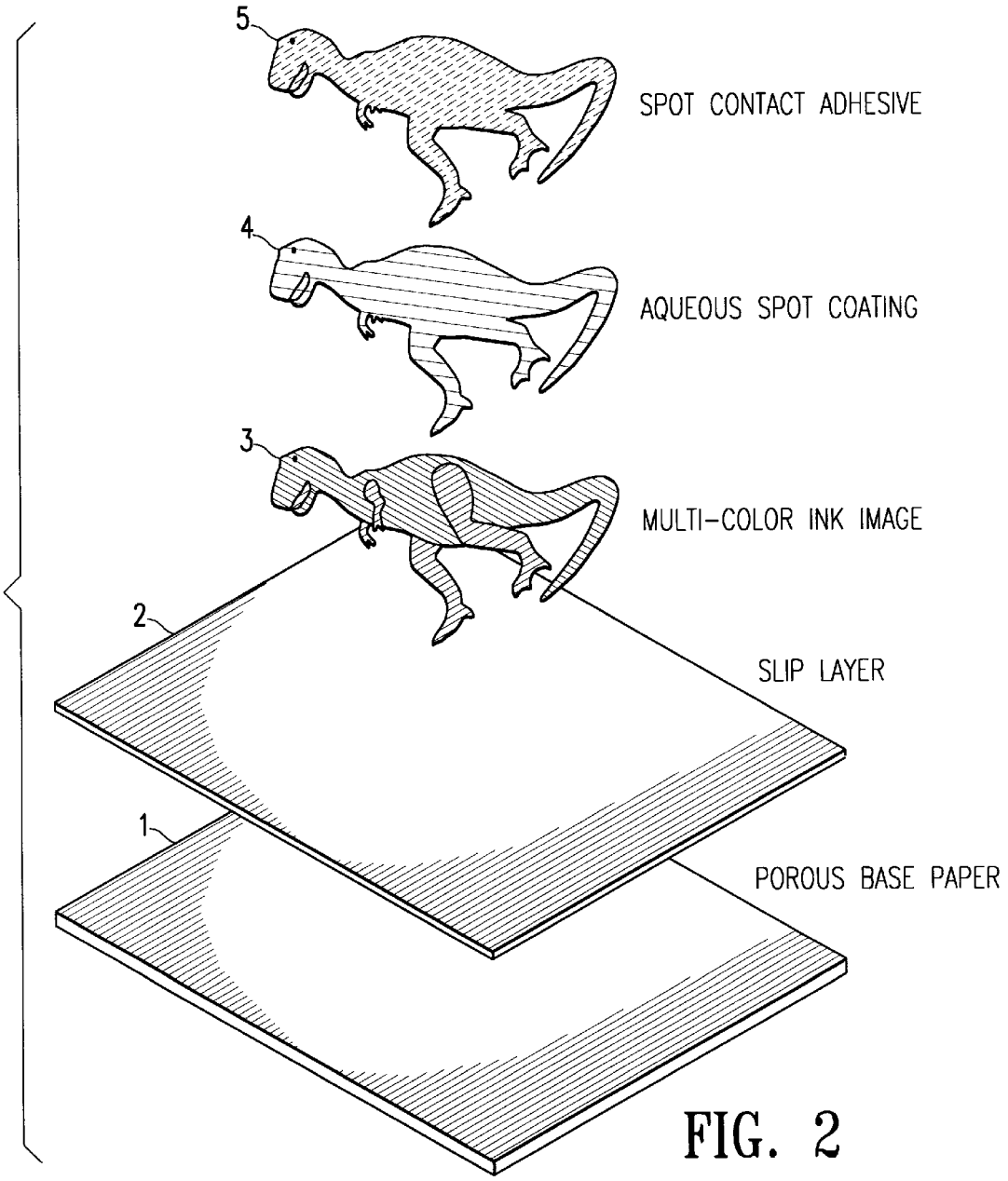
FIG. 2 is an exploded front perspective view of a decal made in accordance with the present invention.

FIG. 1 is a cross-sectional view of a temporary tattoo decal made in accordance with the present invention. FIG. 2 is an exploded front perspective view of a decal made in accordance with the present invention. The vertical dimensions in the figures have been exaggerated for clarity.

The inventive decal structure uses a porous paper base 1 coated (usually, just one side) with a water-soluble slip layer 2, which may be, for example, dextrin gum. The combination of the porous paper base 1 and the slip layer 2 is available as standard prefabricated decal paper from a variety of sources. The preferred embodiment uses "Skincal" paper, available from Tullis Russell, Inc. of Great Britain. An ink image 3, which is typically multicolor, is directly printed onto the slip layer 2. For temporary tattoos to be applied to skin, the offset printing inks should be made with pigments that are certified by the FDA for use in drugs and cosmetics. Such inks are available in a variety of colors. In particular, the preferred embodiment uses "No-Tox" ink, available from Colorcon, Inc. of Westpoint, Pa.

The offset inks are printed directly on the slip layer 2 in designated image areas by means of a conventional offset printing press using ink and water. Lithographic presses suitable for such printing are capable of printing up to 8 colors plus a coating in-line. One such printing press is the "Lithrone 40", available from Komori Corporation of Japan.

After the ink image 3 is printed, a spot coating 4 is printed over the ink image 3 areas with a matte or semi-gloss finish. Such a finish is important, since a glossy finish may be visibly apparent in areas around and in-between design elements of the ink image 3, and may even show through transparent inks. In the preferred embodiment, the spot coating 4 comprises aqueous primer #1198C, available from CAC Coatings & Adhesives. A clear varnish may also be used.

In the preferred embodiment, the spot coating 4 closely conforms to the shape of the ink image 3. However, the spot coating 4 may extend out somewhat around the ink image 3 for additional coverage and into connecting areas between ink images 3 that are part of the same overall design (e.g., several small hearts or stars that are to be applied as one design).

In the preferred embodiment, when using an aqueous coating, the spot coating 4 imprints in-line with the offset (lithographic) press using a coating tower or roll-away coating unit incorporated into the last printing unit of the offset press, with a photo-etched cyrel plate defining the spot print areas. In an alternative embodiment, when using a non-aqueous coating material, such as clear varnish, a standard printing unit on the offset press can be used to define and print the spot coating 4 print areas; no cyrel plate is required. In either case, the spot coating 4 can be applied as a second pass on the offset press rather than in-line.

A contact adhesive 5 is then spot printed over the spot coating 4. In the preferred embodiment, a silk screen press is used to print the spot contact adhesive 5. A suitable contact adhesive is Nacor Adhesive #9890, available from National Starch, Inc. of Los Angeles, Calif.

As is known in the art, the ink image 3, spot coating 4, and contact adhesive 5 are printed with the images in reverse, so that the design will appear properly oriented after the decal is applied.

Lastly, a protective cover sheet, such as a silicone-coated paper, is placed over the contact adhesive 5 of each printed sheet of decals, in order to protect the decal images and to keep printed decal sheets from sticking together. A suitable cover sheet is polypropylene.

The spot coating 4 acts as a protective layer when the finished decal is applied to the skin as a temporary tattoo. Without the spot coating 4 acting as a protective layer, the contact adhesive 5 would migrate through the ink image 3, and the temporary tattoo would feel tacky to the touch. Further, the decal would come off faster because of friction with the surrounding environment.

An important aspect of spot printing the spot coating 4 over the ink image 3 (as opposed to covering the sheet with such a coating) is that the spot coating 4 has a filmy appearance on non-printed areas. If the entire sheet were coated, the spot coating 4 would be visible in areas surrounding the temporary tattoo design, outside of the image area, after the decal is applied to the skin. The spot coating 4 is essentially invisible underneath the ink image 3 after application to the skin.

Advantages of using the preferred aqueous coating material for the spot coating 4 include quick drying time, allowing for easier handling; less ink set off because of the quick drying time; and a thicker coating layer, which provides for greater protection against migration of the contact adhesive 5.

While the figures show only one ink image being created as a decal, one of ordinary skill in the art would understand that multiple ink images would normally be printed at one time on large sheets of decal paper, preferably using a high speed lithographic press. Using current technology, as many as 15,000 sheets of decals can be printed per hour using the inventive method and decal structure.

To apply a temporary tattoo decal, the protective cover sheet 6 would be removed from a printed decal and the contact adhesive 5 side of the decal would be placed on the skin. The porous paper base 1 would then be saturated with water to dissolve the slip layer 2. When the slip layer 2 has dissolved, the porous paper base 1 can be removed from the decal structure, leaving the ink image 3 in place on the skin.

Because the upper-most layer of the applied decal is the printed ink image 3, without any coating layer, and the spot coating 4 has a matte or semi-gloss finish, a temporary tattoo decal made in accordance with the present invention simulates a real tattoo more closely than the prior art. Thus, temporary decal tattoos made in accordance with the present invention are more acceptable to consumers.

A number of embodiments of the present invention have been described. Nevertheless, it will be understood that various modifications may be made without departing from the spirit and scope of the invention. Accordingly, it is to be understood that the invention is not to be limited by the specific illustrated embodiment, but only by the scope of the appended claims.

What is claimed is:

1. A temporary tattoo decal comprising:

(a) a porous paper base;

(b) a water-soluble slip layer on at least one surface of the paper base;

(c) at least one image of lithographic printing ink directly offset imprinted on the slip layer;

(d) a spot coating printed over essentially only each image;

(e) a contact adhesive spot printed over essentially only each image, wherein the spot coating acts as a protective layer that keeps the contact adhesive spot from migrating to the surface of the decal after the finished temporary tattoo is applied to the skin.

2. The temporary tattoo decal of claim 1, further including:

(a) a removable cover sheet placed over the contact adhesive.

3. The temporary tattoo decal of claim 1, wherein the lithographic printing ink is skin-safe.

4. The temporary tattoo decal of claim 1, wherein the spot coating is an aqueous material.

5. A method of manufacturing a temporary tattoo decal, comprising the steps of:

(a) providing a porous paper base having a water-soluble slip layer on at least one surface of the paper base;

(b) lithographically printing ink to form at least one image directly on the slip layer;

(c) applying a spot coating over essentially only each image;

(d) applying a contact adhesive spot over essentially only each image, wherein the spot coating acts as a protective layer that keeps the contact adhesive spot from migrating to the surface of the decal after the finished temporary tattoo is applied to the skin.

6. The method of claim 5, further including the step of:

(a) applying a removable cover sheet over the contact adhesive.

7. The method of claim 5, wherein the ink is skin-safe.

8. The method of claim 5, wherein the spot coating is an aqueous material.

* * * * *